US009086218B2

(12) United States Patent
Wild

(10) Patent No.: US 9,086,218 B2
(45) Date of Patent: Jul. 21, 2015

(54) CHIMNEY BLOCKING APPARATUS

(76) Inventor: Simon Christopher Wild, London (GB)

( * ) Notice: Subject to any disclaimer, the term of this patent is extended or adjusted under 35 U.S.C. 154(b) by 0 days.

(21) Appl. No.: 13/985,871

(22) PCT Filed: Feb. 13, 2012

(86) PCT No.: PCT/GB2012/050311
§ 371 (c)(1),
(2), (4) Date: Oct. 15, 2013

(87) PCT Pub. No.: WO2012/110792
PCT Pub. Date: Aug. 23, 2012

(65) Prior Publication Data

US 2014/0020674 A1 Jan. 23, 2014

(30) Foreign Application Priority Data

Feb. 17, 2011 (GB) ..... 1102734.9

(51) Int. Cl.
*F23L 11/00* (2006.01)
*F23J 13/08* (2006.01)

(52) U.S. Cl.
CPC ..... *F23L 11/005* (2013.01); *F23J 13/08* (2013.01)

(58) Field of Classification Search
CPC ..... F23L 11/005; F24B 1/18; F24B 1/1895; E04F 19/005; A45B 19/00; F23J 13/08
See application file for complete search history.

(56) References Cited

U.S. PATENT DOCUMENTS

| | | | | | |
|---|---|---|---|---|---|
| 605,128 | A | * | 6/1898 | Padgett | 126/319 |
| 1,129,535 | A | * | 2/1915 | Archibald | 126/319 |
| 3,232,207 | A | | 2/1966 | Gibbons | |
| 4,476,852 | A | | 10/1984 | Lee et al. | |
| 4,649,896 | A | * | 3/1987 | Formosa | 126/319 |
| 4,762,115 | A | * | 8/1988 | Penner | 126/319 |
| 5,125,869 | A | | 6/1992 | Vonsick | |
| 5,267,583 | A | * | 12/1993 | Wu | 135/24 |
| 5,857,904 | A | * | 1/1999 | Van Horn | 454/4 |
| 5,881,420 | A | | 3/1999 | Brickelmyer | |
| 6,467,096 | B1 | * | 10/2002 | Coluccio | 2/195.2 |
| 2009/0151760 | A1 | * | 6/2009 | Brader | 135/31 |
| 2009/0223504 | A1 | * | 9/2009 | Williams | 126/319 |
| 2010/0180559 | A1 | | 7/2010 | Caro | |

OTHER PUBLICATIONS

PCT Notification of Transmittal of the International Search Report and Written Opinion of the International Searching Authority dated Mar. 26, 2012.

* cited by examiner

*Primary Examiner* — Alissa Tompkins
*Assistant Examiner* — Benjamin W Johnson
(74) *Attorney, Agent, or Firm* — E. Victor Inriano; Indiano Law Group, LLC

(57) ABSTRACT

Chimney blocking apparatus including a handle (4), telescopic support means (6) having a longitudinal axis (7), chimney blocking means (8) and an actuation mechanism configured to firstly extend the telescopic support means (6) and deploy the chimney blocking means (8) outwardly and secondly collapse the chimney blocking means 8 inwardly towards the longitudinal axis (7). The actuation mechanism may include a first resilient means for collapsing the chimney blocking means (8).

17 Claims, 13 Drawing Sheets

CHIMNEY BLOCKING APPARATUS

The present invention relates to chimney blocking apparatus for inserting into a chimney from a fireplace to prevent, or at least substantially eliminate, warm air from a building leaving the building by means of the chimney.

Certain devices are available for blocking off a chimney when it is not in use. One of the more commonly available devices comprises an inflatable bag which is pushed a short distance up a chimney from a fireplace and then inflated until its outer surface engages an inner surface of the chimney. Such a device is awkward to use. Firstly, it has to be held at the required height while it is inflated. Secondly, the process of inflating and deflating the device is time consuming and inconvenient and requires the provision of a pump or other inflation means. Thirdly such devices do not collect debris which may fall down a chimney and tend to let such debris fall into the fireplace, and possibly onto a floor in front of a fireplace, when the device is collapsed for removal.

An object of the invention is to provide a chimney blocking apparatus which is easier to use than typical prior art chimney blocking devices and overcomes at least some of the above disadvantages.

According to the invention there is provided chimney blocking apparatus including a handle, support means extending from the handle and being extendable along a longitudinal axis, chimney blocking means deployable outwardly away from the longitudinal axis and an actuation mechanism configured to firstly extend the support means and deploy the chimney blocking means outwardly and secondly collapse the chimney blocking means inwardly towards the longitudinal axis.

Preferably the actuation mechanism includes first resilient means for extending the support means and deploying the chimney blocking means outwardly and a second resilient means for collapsing the chimney blocking means inwardly towards the longitudinal axis. This arrangement provides a particularly convenient way of powering deployment and collapsing of the apparatus.

Preferably the actuation mechanism includes a first hub displaceable along the support means and a second hub also displaceable along the support means and situated closer to the handle than the first hub. Such an arrangement permits the chimney blocking means to be moved upwardly away from the handle prior to outward deployment away from the longitudinal axis.

Preferably a distance between the first and second hubs is variable and the second resilient means is situated between the first and second hub to bias them away from each other, thereby allowing relaxing of the second resilient means to effect inward collapsing of the chimney blocking means.

Preferably the actuation mechanism includes a flexible tension member. This arrangement permits convenient control over movement of the chimney blocking means along the support means and deployment and collapsing of the chimney blocking means.

Preferably the actuation mechanism further includes releasable securing means for releasably securing the flexible tension member with respect to the handle in order that initiation of inward collapsing of the chimney blocking means can be effected from the handle.

The apparatus preferably further includes guide means for guiding a head connected to the flexible tension member into engagement with the releasable securing means as the support means is compressed into a non-extended configuration, whereby collapsing of the apparatus will automatically place it in a state ready for deployment without any further steps being necessary.

Preferably the flexible tension member extends between the first and second hubs, whereby the flexible tension member can be used to automatically effect outward deployment of the chimney blocking means as the support means telescopes outwardly.

Preferably a bight of the flexible tension member is situated at a distal portion of the support means.

Preferably the first hub includes an abutment surface which is selectively engageable with a complementary stop surface of the support means to arrest displacement of the first hub along the support means. This arrangement permits initiation of outward deployment of the chimney blocking means to be effected automatically.

Preferably the actuation mechanism includes a releasable retention means for releasably retaining the support means in a non-extended configuration.

Preferably the chimney blocking means includes a collapsible spoked frame and a flexible membrane. Such an arrangement provides a light and quickly deployable arrangement which can easily be designed to be sufficiently flexible to accommodate chimney irregularities and different chimney sizes.

Preferably the chimney blocking means, in a deployed configuration, has a concave surface facing away from the handle, in order that the apparatus will effectively collect any debris falling down the chimney.

Preferably the chimney blocking means has a substantially quadrilateral perimeter when deployed so as to fit conveniently and effectively in a typical chimney having a quadrilateral cross-section.

Preferably the chimney blocking means includes a flexible membrane and further includes adjustment means for adjusting a peripheral portion of the flexible membrane, in order to reduce the tendency of folds to form in the flexible membrane when the apparatus is deployed in a relatively small chimney. Where the chimney blocking means has a substantially quadrilateral perimeter, more preferably the adjustment means includes independent adjustment means for individually adjusting peripheral portions on different sides of the substantially quadrilateral perimeter in order that the apparatus can be configured to fit snugly in a chimney having a rectangular cross-section.

The invention will now be described by way of example only with reference to the accompanying schematic drawings in which.

Figure 1:
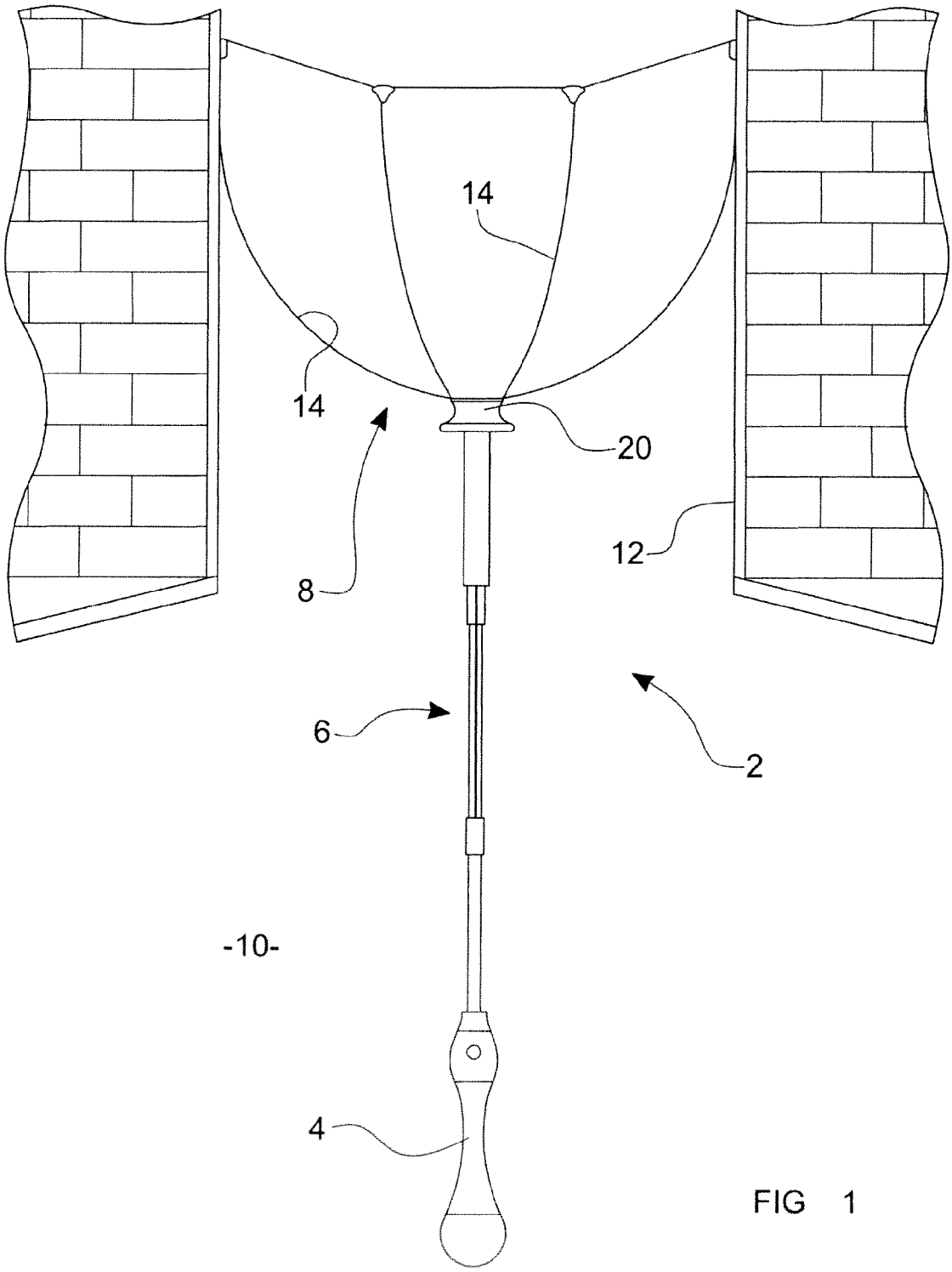
FIG. 1 shows a chimney blocking apparatus according to the invention in a deployed configuration in a chimney.
Figure 7:
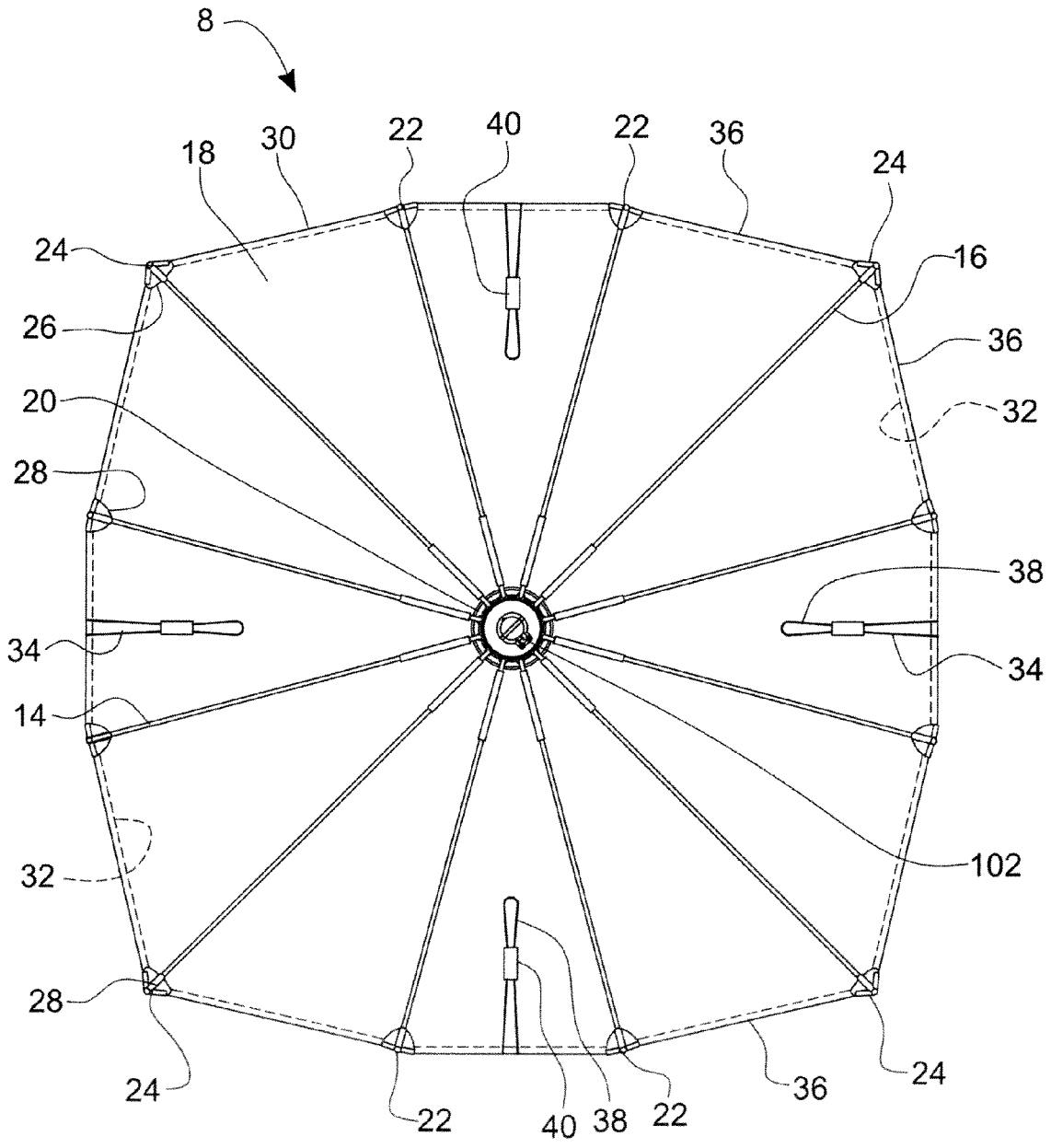
FIG. 7 is a top plan view of the chimney blocking apparatus according to the invention complete with its canopy in its deployed configuration.

FIG. 1 shows a chimney blocking apparatus 2, according to the invention, which includes a handle 4, a support means 6, a chimney blocking means 8 and a deployment mechanism which will be described in detail below. The apparatus is shown in FIG. 1 in a fully deployed configuration blocking a chimney 12 which leads upwardly from a fireplace 10. A further view of the deployed apparatus is shown in FIG. 7 which is a top plan view. The chimney blocking means 8 includes radiating side spokes 14 and corner spokes 16. A flexible membrane or canopy 18 covers the spokes. The canopy may be formed of any suitable fabric and extends from a central second or spoke hub 20 to spoke end fittings 22 and 24. These fittings include side spoke end fittings 22 and corner spoke end fittings 24. Each spoke end fitting includes an attachment part 26, for connection to the canopy 18 by any suitable means such as sewing, and a tubular spoke receiving part 28 into each of which a spoke end is secured by any suitable means such as with glue.

In the particular embodiment shown, which is for deployment in a chimney with a quadrilateral cross-section, a perimeter 30 of the canopy 18 is substantially quadrilateral in shape. A seam 32 extends around the perimeter 30. Between each adjacent pair of corner spoke end fitting 24, and with opposite ends connected thereto, is provided a flexible cord 34 or like member which may be resilient and for example made out of shock cord. At an intermediate point along each side 36 of the canopy 18 a loop 38 of the flexible cord 34 protrudes from the seam 32 and a sliding length adjuster 40 is slidably mounted on the loop 38. By adjusting the position of each length adjuster 40 along the respective loop 38 the length of the flexible cord 34 extending directly between adjacent corner spoke fittings 24 can be altered. This length is reduced when the apparatus is to be used to block a chimney having a relatively small width. Without such adjustment, if the apparatus was deployed in a relatively narrow chimney, loose folds would form along the sides 36 of the canopy 18 leading to a less effective blocking of the chimney. Furthermore, if the lengths of the flexible cords on two opposed sides 36 are shortened by a first amount and those on the two remaining sides 36 are shortened by a different second amount, the apparatus can be adapted for deployment in a chimney with a rectangular cross-section. Less than four cords may be provided extending around the perimeter 30 of the canopy 18, such as one or two.

As an alternative to the arrangement shown in FIG. 7, the apparatus could be configured for deployment in a chimney with a circular cross-section. In this case, the spokes would all be the same length and the canopy would have a multi-sided polygonal or substantially circular perimeter. As for the embodiment described with reference to FIG. 7, one or more sliding length adjusters could be provided in one or more flexible cords extending through a seam in a perimeter of the canopy.

The spokes 14, 16 are preferably flexible in order that they can bend, as shown in FIG. 1, to accommodate irregularities in an inner surface of a chimney and in order to provide a resilient engagement of the chimney blocking means 8 with the inner surface of the chimney.

Other parts of the apparatus will now be described with particular reference to the attached figures. The canopy 18 is not shown in FIGS. 2 to 6 and 8 to 12 in order that other parts being described are clearly visible. The complete deployment and collapsing sequence will thereafter be described with reference to various figures which show different stages of this sequence.

Figure 8:
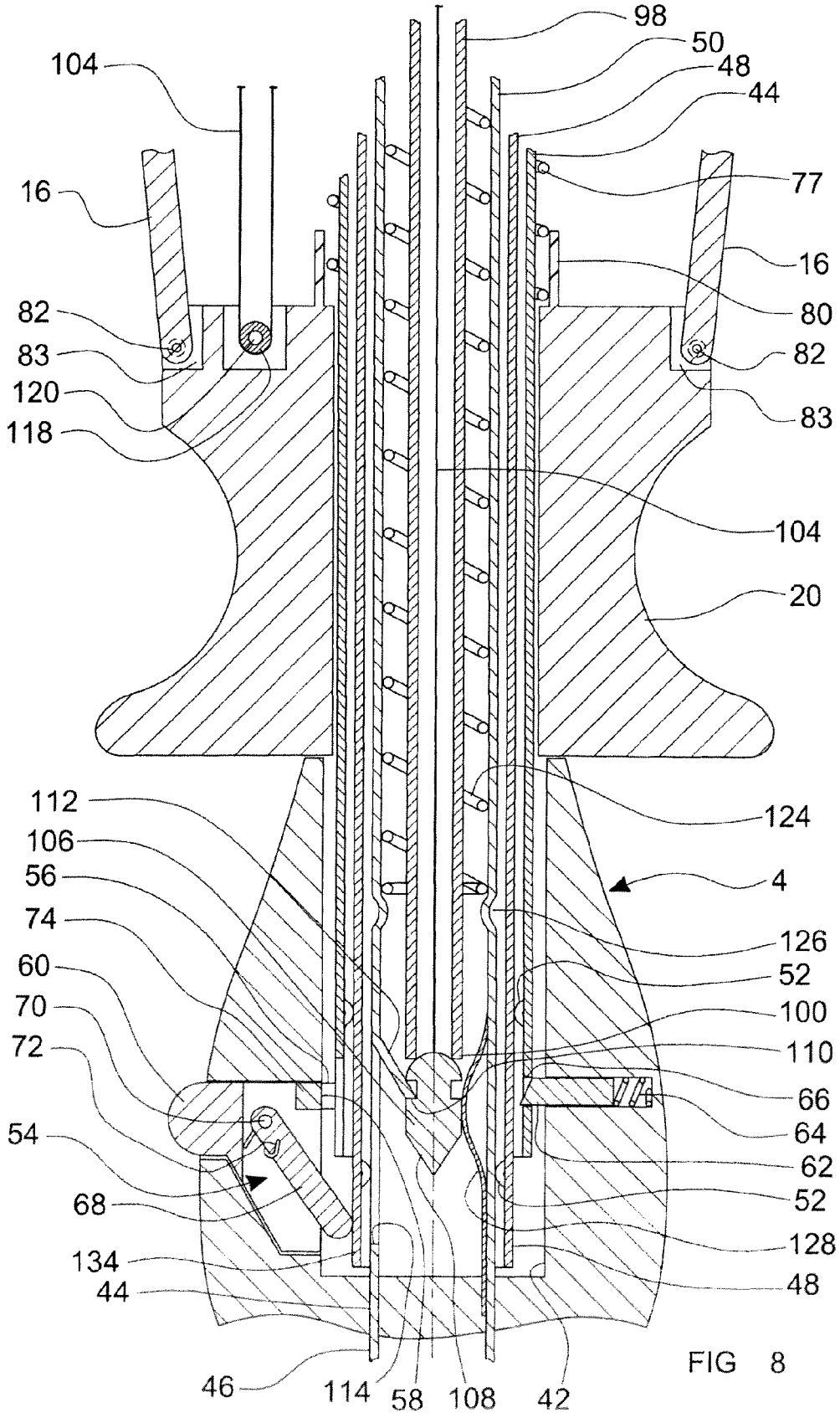
FIG. 8 is an enlarged detailed cross-sectional view of a handle region of the apparatus without the canopy shown in FIG. 2.

FIG. 8 is a detailed cross-sectional view of a handle region of the apparatus in its fully collapsed configuration. The handle 4 includes a recess 42 and a first or lower support member 44 has a proximal end 46 secured in a base of the recess 42. The support means 6 comprises the first or lower support member 44, a second or middle support member 48 and a third or upper support member 50. The middle support member 48 telescopically engages the lower support member 44. The upper support member 50 telescopically engages the middle support member 48. In the embodiment shown, all these support members are cylindrical. The cylindrical support members may have circular cross-sections but preferably have non-circular e.g. polygonal, cross-sections to limit rotation of each support member relative to adjacent support member(s). Alternative rotation prevention means may be provided such as complementary ribs and grooves on interengaging parts of the support means 6.

In the embodiment shown, the lower support member 44 is slidingly received inside the middle support member 48 which in turn is slidingly received inside the upper support member 50. The support means 6 could include 2 support members only or more than three.

At or adjacent to interengaged ends of the support members 44, 48 and 50, disengagement prevention means are provided in the form of projections 52 which can butt up against each other, or against other stop means, to limit outward telescoping of the support members relative to each other.

Figure 9:
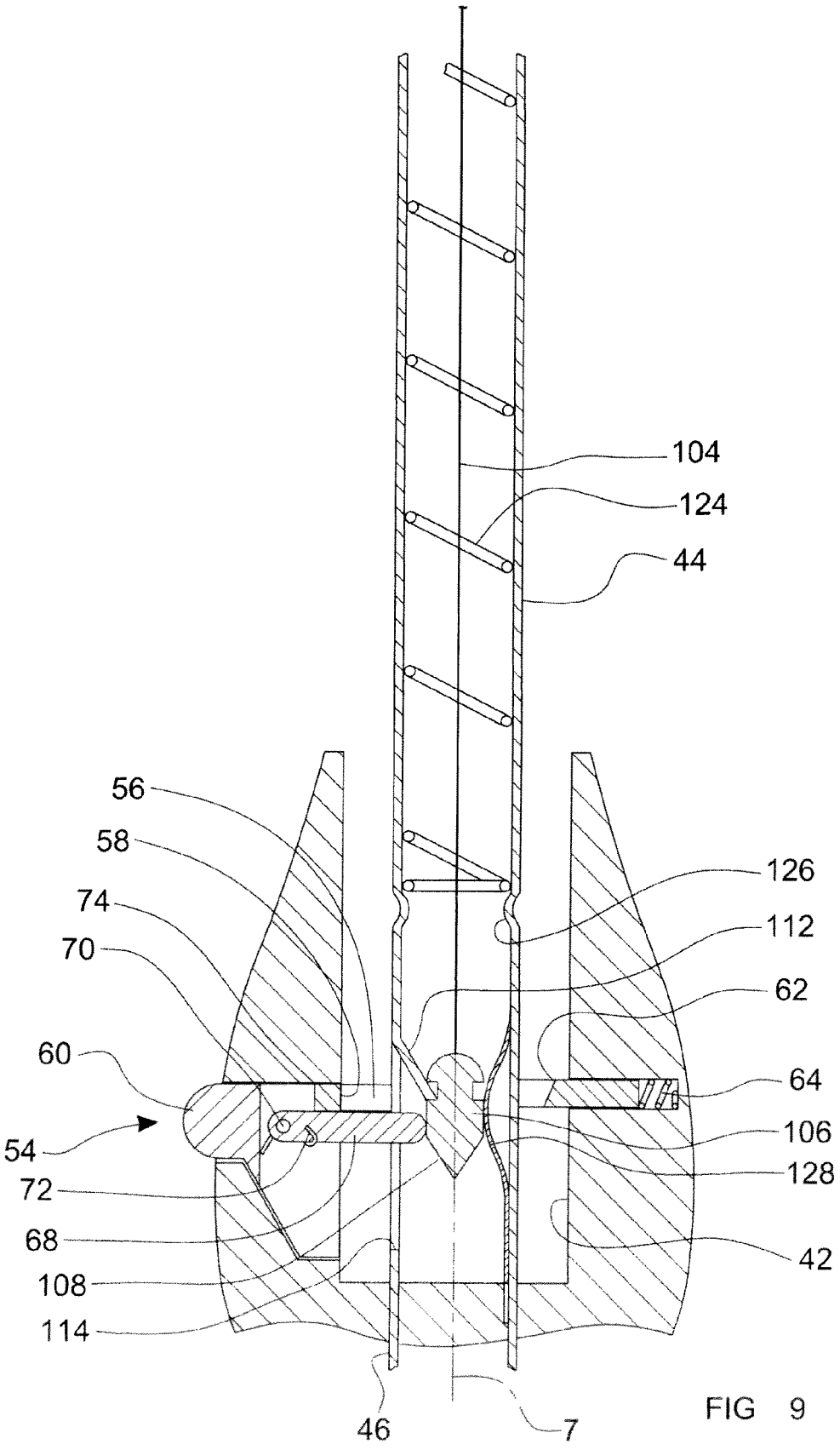
FIG. 9 is a cross-sectional view of the handle region of the apparatus without its canopy shown in FIG. 8 in an intermediate deployment configuration.

The handle 4 accommodates part of the actuation mechanism including a dual release system 54. The dual release system 54 includes a ring-like member 56 with an opening 58 through which the lower support member 44 extends. On one side of the ring member 56 a push-button 60 is provided. An inwardly directed retention projection 62 is provided opposite the push-button 60. A push-button return spring 64 urges the ring member 56 to the left as viewed in FIG. 8 so that when the apparatus is fully collapsed, the retention projection 62 engages a complementary aperture 66 in an end region of the upper support member 50, as shown in FIG. 9, to hold the support members 44, 48 and 50 fully telescoped together.

The dual release system 54 also includes a pusher member 68 which is rotatable about a pin 70 and biased towards the lower support member 44 by a spring 72. The pusher member 68 is rotated by the spring 72 in an anticlockwise direction as viewed in FIG. 8 and this rotation is limited by a stop 74 formed integrally with the ring member 56.

Figure 10:
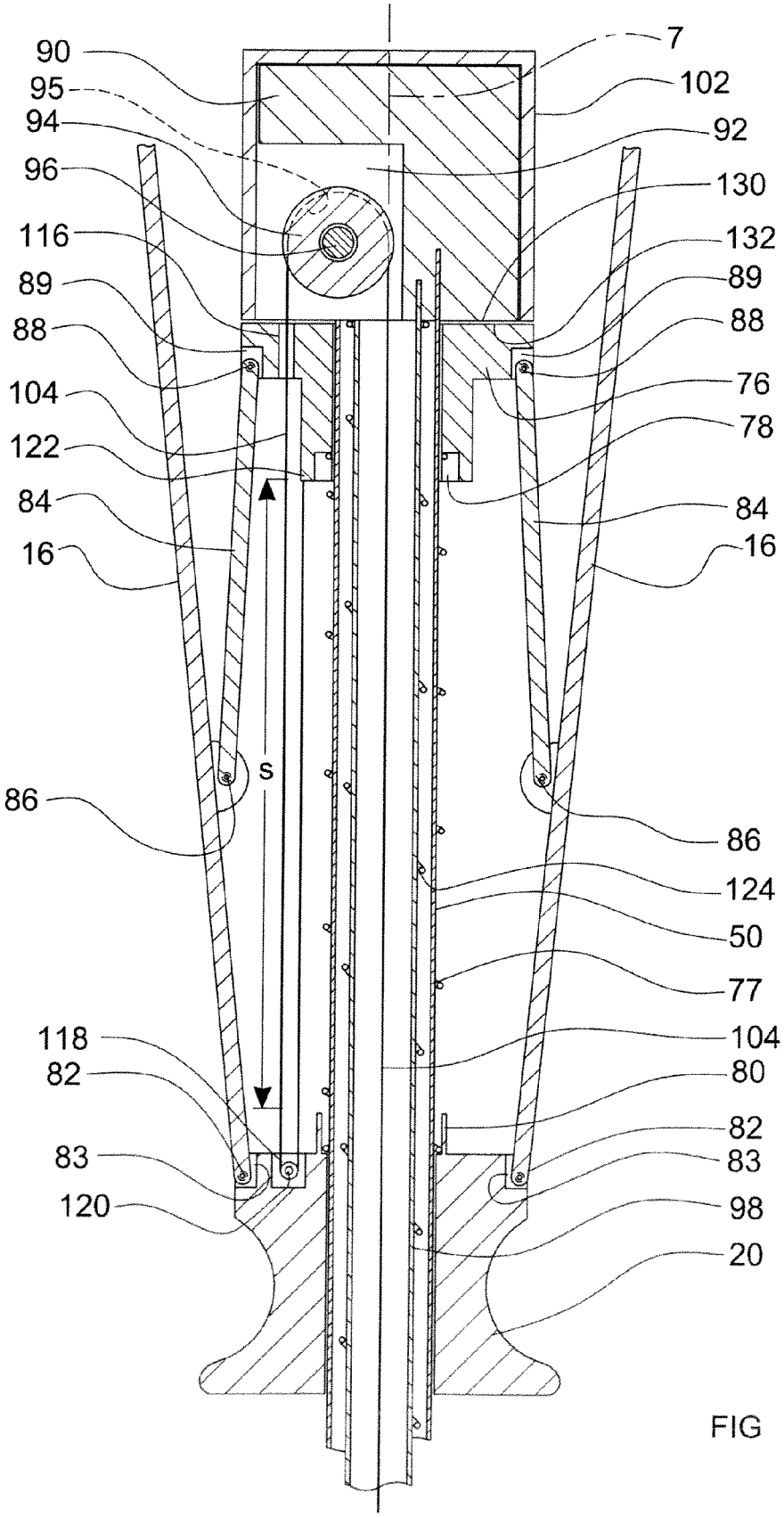
FIG. 10 is a cross-sectional view of an upper portion of the apparatus without its canopy shown in FIG. 9 in its intermediate deployment configuration.

The upper portion of FIG. 10 shows how the spokes supporting the canopy 18 (omitted from FIG. 8 for clarity) are connected to the upper support member 50.

A first hub or link hub 76 surrounds the upper support member 50 and is slidable therealong. The second hub or spoke hub 20 also surrounds the upper support member 50 on the handle side of the link hub 76 and is also slidable along the upper support member 50. A second resilient means or canopy collapsing spring 77 is positioned between the two hubs 20 and 76 and biases them away from each other. An upper or distal end of the canopy collapsing spring 77 is accommodated in an annular recess 78 in the link hub 76 and a lower or proximal end of the canopy collapsing spring 77 is held in place by an annular wall 80 projecting upwardly from the spoke hub 20. Each of the spokes 14 and 16 has an inner end pivotably connected to the spoke hub 20. Only corner spokes 16 are shown in FIG. 10. The inner end of each spoke has an enlarged spoke head 82 which is force fitted into a complementary recess 83 in the spoke hub 20. An intermediate part of each spoke 14 and 16 is connected to a link 84 by a link pivot pin 86 and the opposite end of each link 84 is pivotably connected to the link hub 76. The opposite end of each link 84 has an enlarged link head 88 which is force fitted into a complementary recess 89 in the link hub 76. Each head may alternatively or in addition engage the associated hub by means of a push and twist engagement action. Also a resilient sleeve may be interposed between each head and the associated hub.

Connected to a distal end of the upper support member 50 is an end cap 90. The head 90 is shown in schematic form in FIGS. 10 to 12 and does not mirror the external shape of the head shown in the views of the apparatus shown in FIGS. 2 to 6. In a recess 92 in the end cap 90 a head sheave 94 is rotateably mounted on a head spindle 96. A guide means or guide tube 98 is secured to the end cap 90 and extends towards the handle 4 inside the upper support member 50. The guide tube 98 is approximately the same length as the upper support member 50 and has an end 100 (see FIG. 8) remote from the end cap 90. A cover 102 surrounds the end cap 90 and is connected thereto by any suitable means such as by glue.

As shown in FIG. 8 a flexible tension member 104 extends through the interior of the support means 6 and the guide tube 98 and has a head 106 connected to a handle end thereof. The flexible tension member is substantially inextensible and may comprise cord and will be described hereafter as the cord 104. The head 106 has an inclined lead-in surface 108 on an end facing away from the cord, and a latching surface 110 on an end facing the cord 104.

In the region of the dual release system 54, the lower support member 44 includes a release aperture 114 and an inwardly directed latch projection 112 at an upper part thereof. Opposite to the latch projection 112 in the lower support member 44, is a latch spring 128.

The cord 104 extends from the head 106 through the support means 6 and the guide tube 98 to the end cap 90 where it passes in a bight 95 around the head sheave 94. From the head sheave 94 the cord extends through a passage 116 in the link hub 76 to and around a spoke hub sheave 118 which is rotatable around a spoke hub spindle 120 connected to the spoke hub 20. From the spoke hub sheave 118 the cord doubles back to an anchor point 122 on the link hub 76.

A first resilient means or deployment spring 124 is positioned inside the support means 6. The deployment spring 124 bears against a spring stop 126 which projects inwardly from a portion of the lower support member 44 and an inner surface of the end cap 90. The deployment spring 124 is a compression spring and acts to urge the end cap 90 away from the handle 4 and thereby outwardly telescope the support means 6. The guide tube 98, with the cord 104 extending therethrough, is situated inside the deployment spring 124.

The deployment and collapsing of the apparatus is described below.

Figure 2:
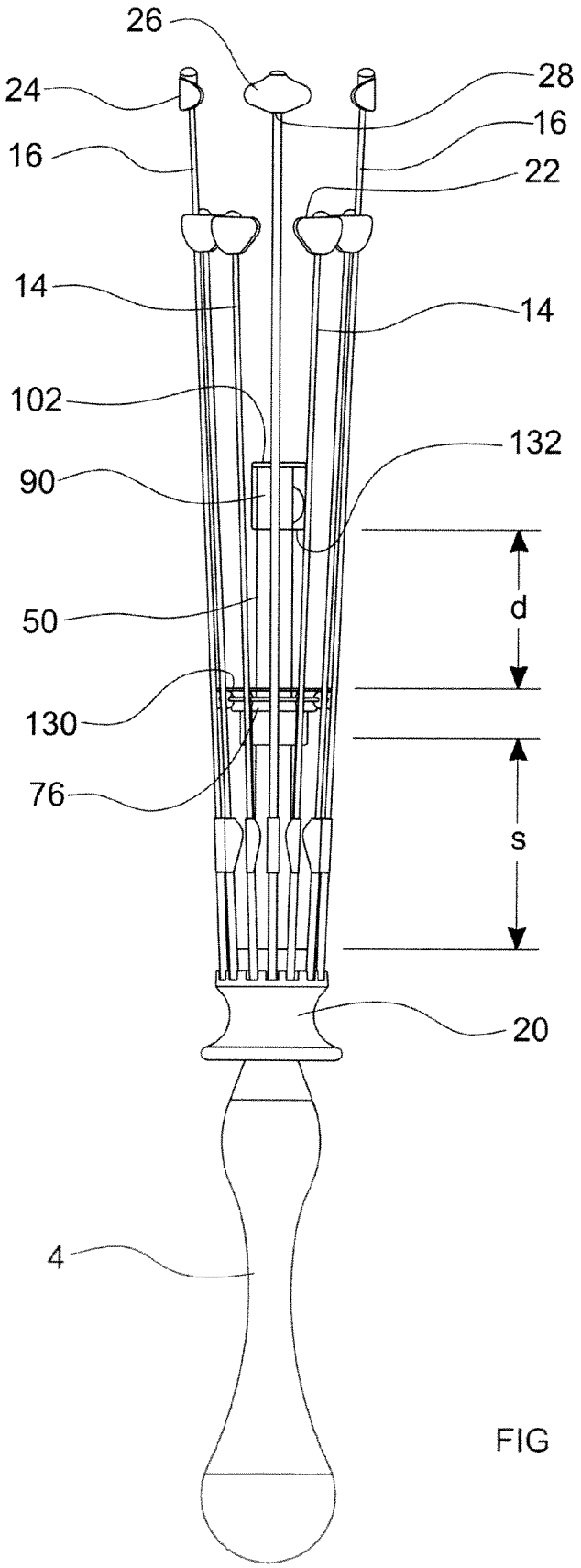
FIG. 2 shows the chimney blocking apparatus according to the invention without its canopy in its collapsed configuration.
Figure 3:
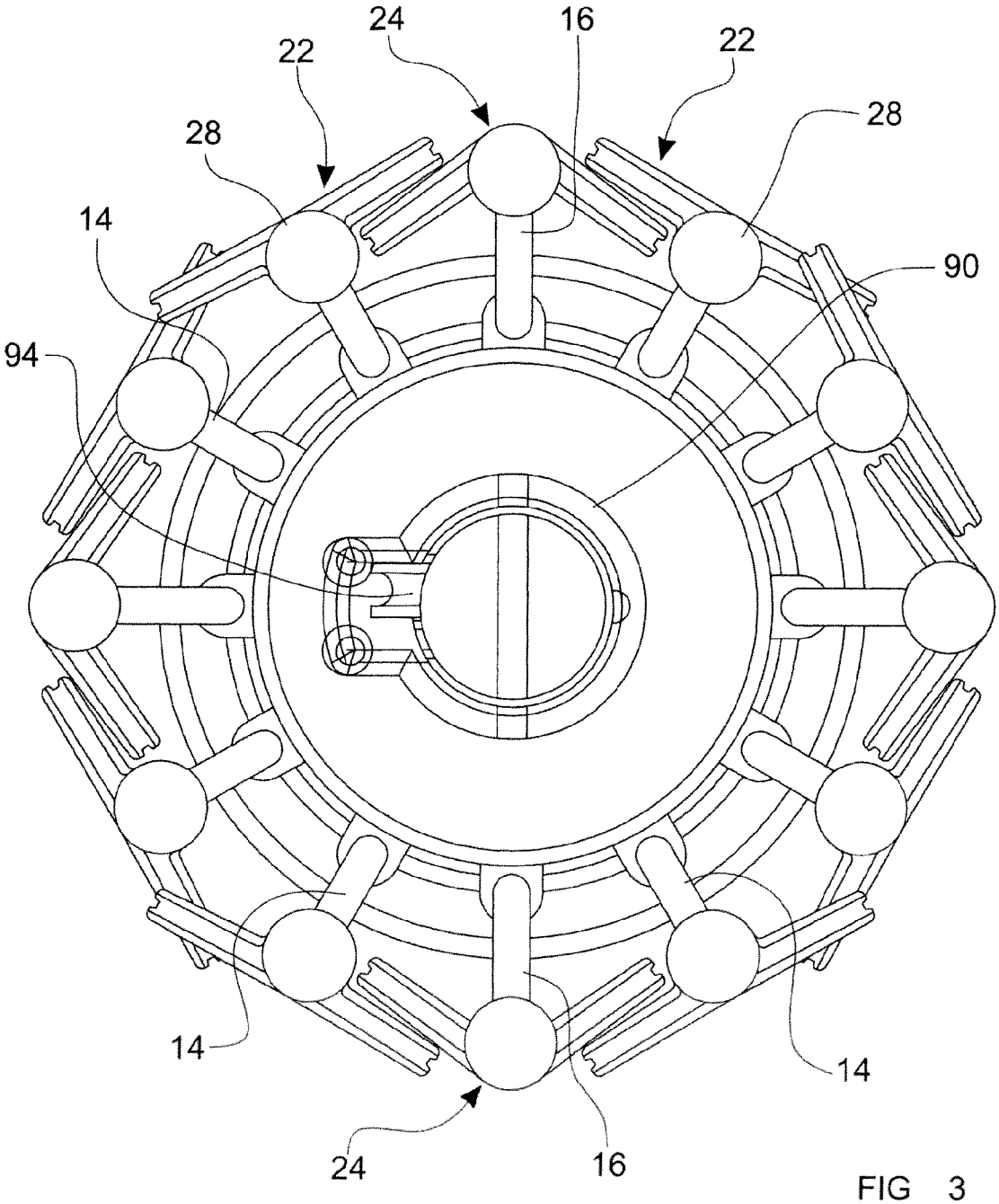
FIG. 3 is a view from above of the apparatus shown in FIG. 2.

The apparatus is shown in side view in its collapsed configuration in FIG. 2 and in plan view from above in FIG. 3 (canopy omitted from these Figs). FIG. 8 shows a schematic cross-sectional view of the handle portion of the apparatus in the its collapsed configuration. The lower 44, middle 48 and upper 50 support members are inwardly telescoped so that the majority of the lower 44 and middle 48 support members are accommodated within the upper support member 50, a lower end of which is situated in the recess 42 of the handle 4. The retention projection 62 of the release system 54 is held engaged by the return spring 64 in the aperture 66 in the upper support member 50, which is the outermost of the three support members. In this configuration, the deployment spring 124 is fully compressed between the end cap 90 and the spring stop 126 in the lower support member 44. The latching surface 110 of the head 106 at the end of the cord 104 is held in engagement with the latch projection 112 by the latch spring 128 in the lower support member 44. The pusher member 68 is held out of engagement with the head 106 by the presence of a lower end 134 of the middle support member 48. An abutment surface 130 of the link hub 76, which faces the end cap 90, is spaced a distance d from a confronting stop surface 132 of the end cap 90. The spoke hub 20 is situated close to or in contact with the handle 4 and the link hub 76 is separated from the spoke hub 20 by a distance s as shown in FIG. 2.

Figure 11:
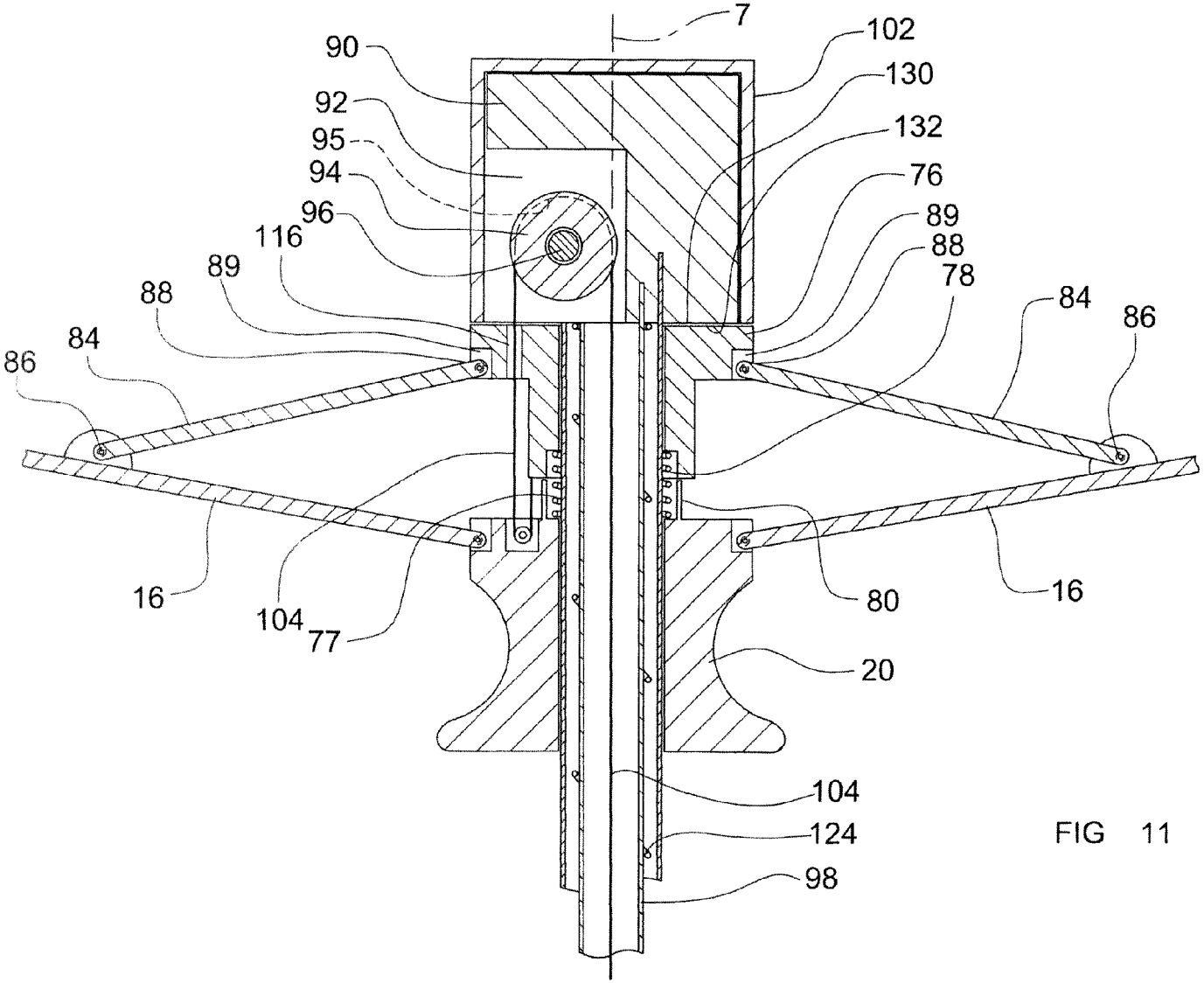
FIG. 11 is a cross-sectional view of the upper portion of the apparatus without its canopy shown in FIG. 10 in its final deployment configuration.
Figure 12:
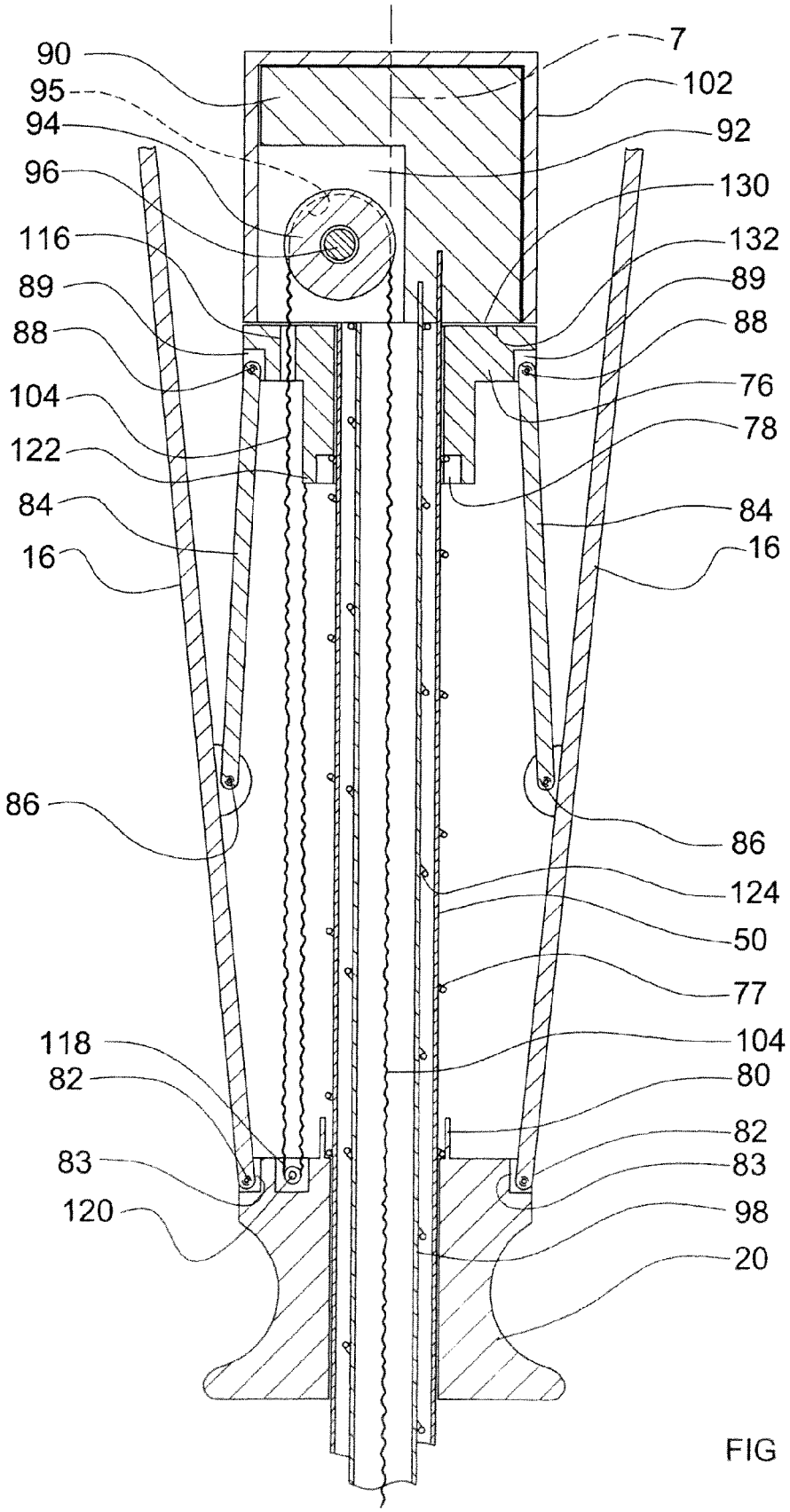
FIG. 12 is a cross-sectional view of the upper portion of the apparatus without its canopy shown in FIGS. 10 and 11 in an intermediate collapsed configuration.

The deployment sequence is initiated by depression of the push button 60, which moves the ring member 56 to the right as viewed in FIG. 8 thereby depressing the push button return spring 64 and releasing the retention projection 62 from the aperture 66 in the upper support member 50. This in turn allows the deployment spring 124 to partly outwardly telescope the support members 44, 48 and 50 to the intermediate deployment configuration shown in FIG. 10. Due to the fact that the head 106 at the end of the cord 104 is restrained by the latch projection 112, as the support means 6 telescopes outwardly, the link hub 76 and the spoke hub 20 are drawn by the cord 104 along the upper support member 50 towards the end cap 90. With the arrangement shown in FIG. 10, with the cord doubled back round the spoke hub sheave 118 and anchored to the link hub 76, for a given displacement distant of the end cap 90 away from the handle 4 the link hub 76 and spoke hub 20 will move in tandem half of the displacement distance towards the end cap 90 with the distance s between the hubs maintained by the canopy collapsing spring 77, remaining substantially constant. Eventually the link hub stop surface 132 comes into contact with the end cap abutment surface 130. This intermediate deployment configuration is shown in FIG. 10 at which point the second deployment stage occurs at the end of which the canopy is fully deployed. FIG. 11 shows schematically the configuration of upper parts of the apparatus in the fully deployed configuration.

Figure 4:
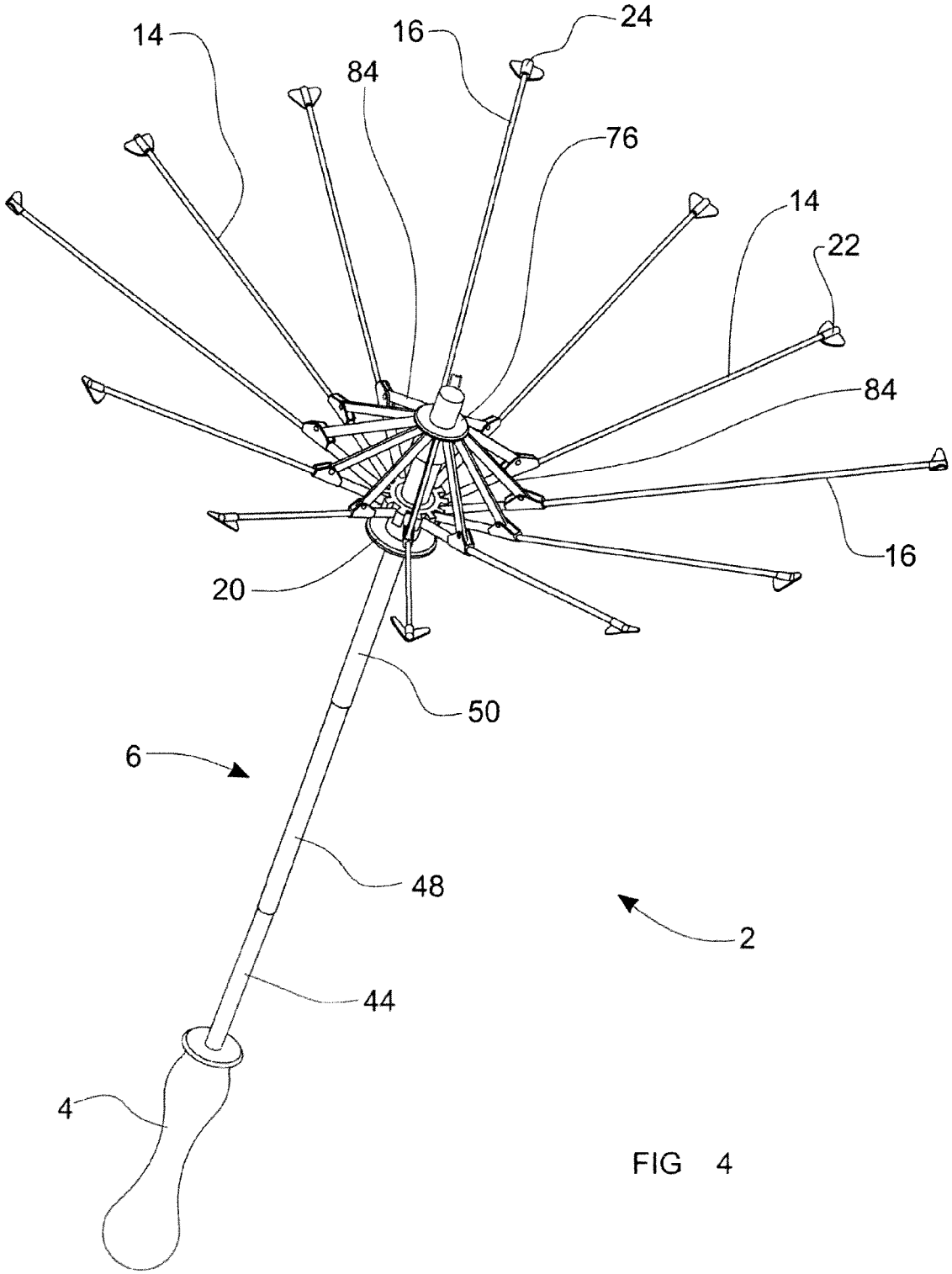
FIG. 4 is a perspective view of the apparatus shown in FIG. 2, in its deployed configuration without its canopy.
Figure 5:
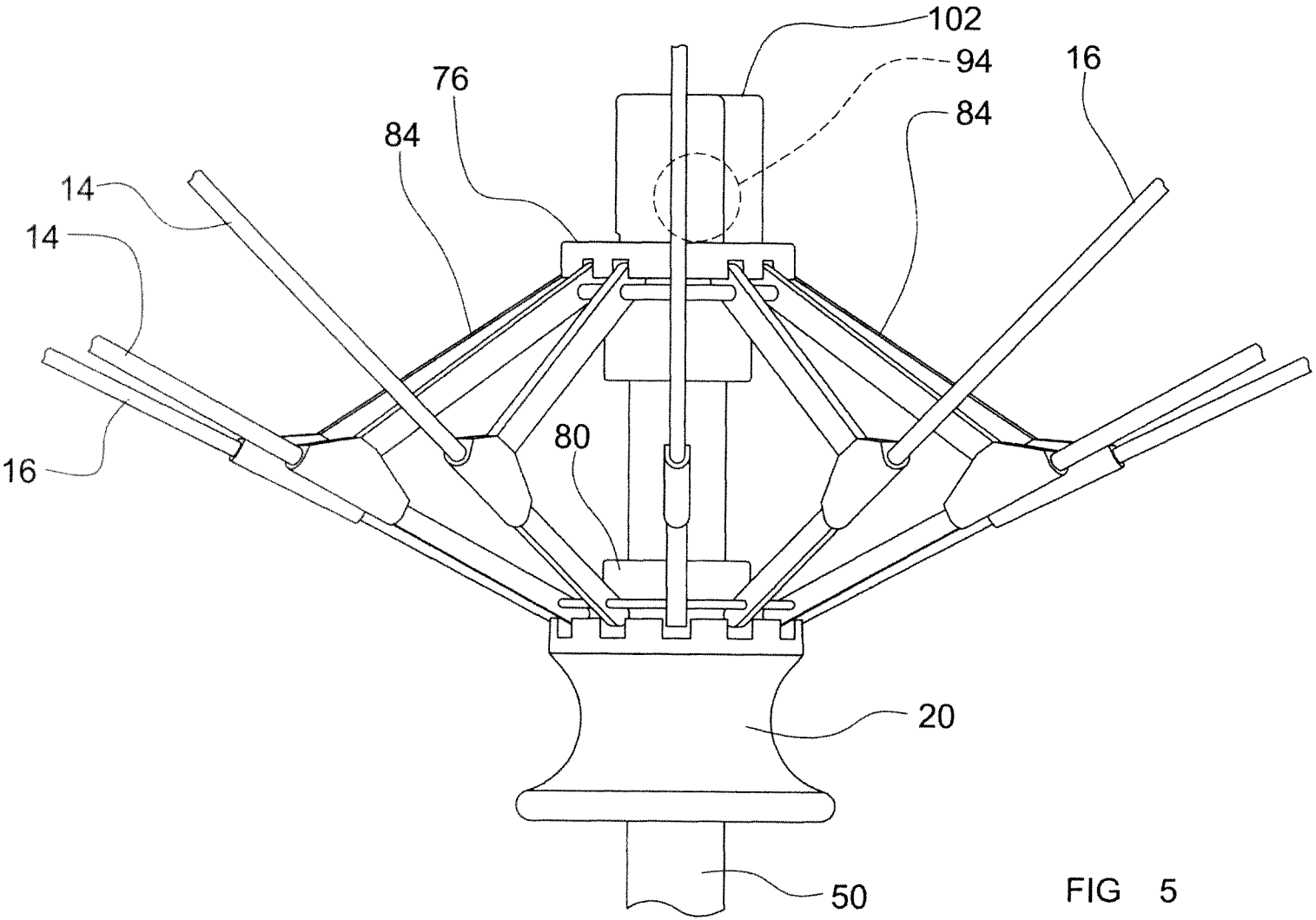
FIG. 5 is an enlarged side view of the deployed apparatus shown in FIG. 4.
Figure 6:
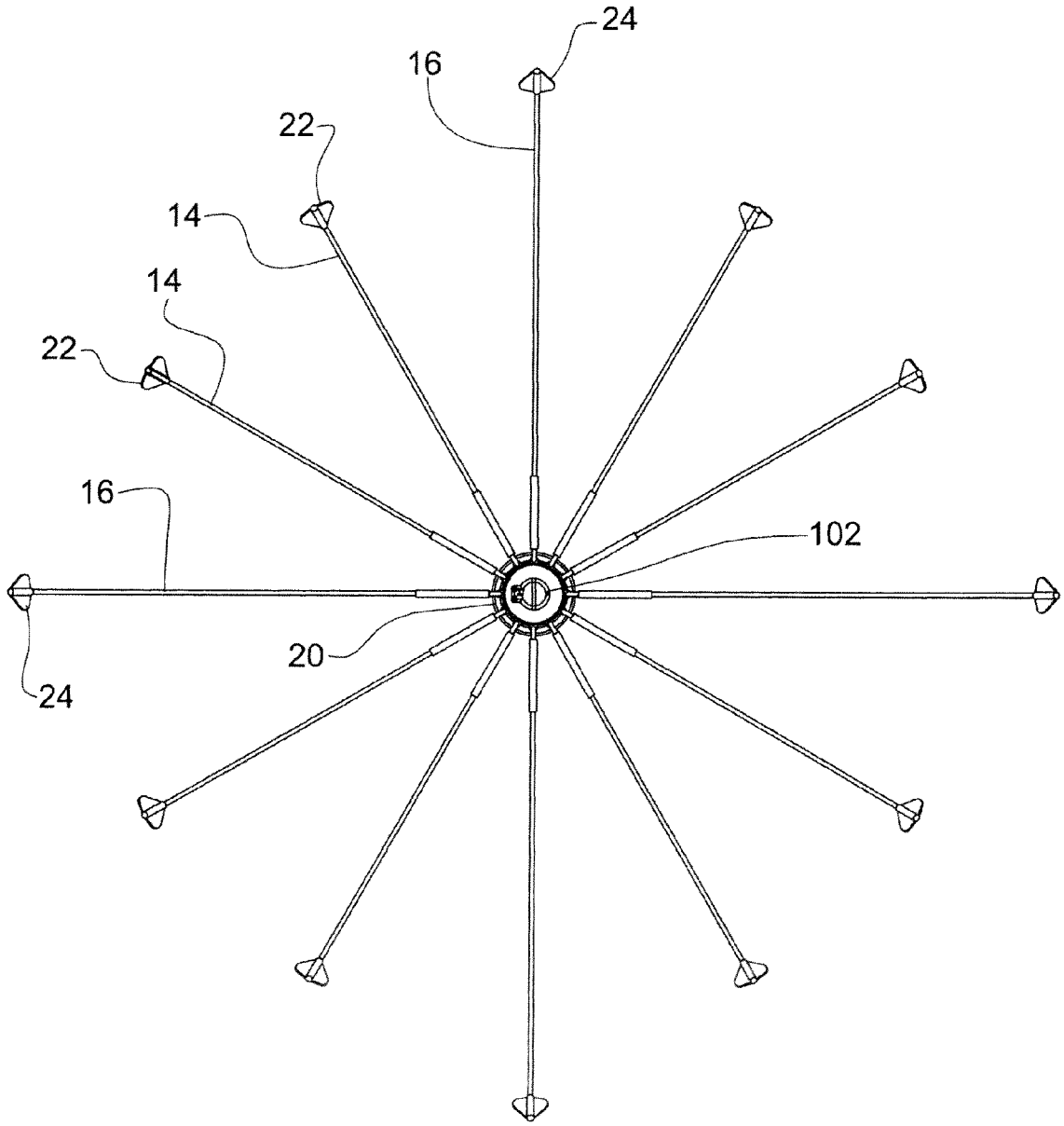
FIG. 6 is a top plan view of the deployed apparatus shown in FIG. 4.

From the intermediate deployment configuration shown in FIG. 10, at which the link hub 76 has just come into contact with the end cap 90, the second deployment stage occurs. Continued outward telescoping of the support members 44, 48 and 50 by the deployment spring 124 results in further cord 104 being drawn around the head sheave 94 and into the support means 6. Since the link hub 76 can no longer move further away from the handle 4 this drawing of the cord results in the spoke hub 20 being drawn towards the link hub 76 thereby compressing the canopy collapsing spring 77 and reducing the distant s between the hubs. As this occurs, the links 84 and spokes 14 and 16 pivot outwardly away from the support means 6. FIG. 10 shows only corner spokes 16. The fully deployed configuration, showing in FIG. 11, is reached when the spoke hub 20 has travelled along the upper support member 50 towards the end cap 90 sufficiently to come into contact with the link hub 76. As the hubs move towards each other the canopy collapsing spring 77 becomes compressed. Alternatively, the fully deployed configuration may be reached when the canopy collapsing spring 77 has become sufficiently compressed that it balances the outward telescoping force of the deployment spring 124. FIGS. 1, 4, 6, 7, 9 and 11 show various views of the apparatus in its fully deployed configuration. In FIGS. 4, 6 and 11 the canopy 18 has been omitted to show other parts of the apparatus more clearly. FIG. 1 shows the apparatus in its fully deployed configuration in a chimney with the spokes curved inwardly by engagement with the chimney 12. The other figures showing the fully deployed configuration show how the apparatus would look if not confined in a chimney with the spokes 14 and 16 remaining straight. It should be noted that, in this fully deployed configuration (see FIG. 9 in particular), the cord 104 is tensioned as a result of the head 106 being engaged by the latch projection 112. It should also be noted that, since the middle support member 48 has moved up the lower support member 44, the spring 72 has been able to rotate the pusher member 68 around the pin 70 into engagement with the stop 74 in which position its end is situated close to the head 106 as shown in FIG. 10.

In its fully deployed configuration, situated in a chimney 12 as shown in FIG. 1, the apparatus both substantially prevents draft up the chimney and also collects any debris, such as soot, which may fall down the chimney.

When there is a requirement to remove the apparatus from the chimney, the push button 60 is depressed for a second time to initiate the first collapsing stage. The push button moves the ring member 56 and the pusher member 68, which is connected thereto, to the right as viewed in FIG. 10. This in turn displaces the head 106 to the right also. As this occurs, the latch spring 128 is compressed and the latching surface 110 of the head 106 disengages from the latch projection 112 thereby releasing the head 106 and the cord 104. Thereafter, the canopy collapsing spring 77 forces the spoke hub 20 downwardly away from the link hub 76 to the intermediate collapsing configuration shown in FIG. 12. As this occurs, the links 84 and spokes 14 and 16 rotate back towards the support means 6, the canopy 18 is accordingly drawn inwardly away from the chimney surface towards the longitudinal axis 7 and the canopy collapsing spring 77 becomes at least substantially relaxed. Cord 104 is also drawn around the head sheave 94 and out of the support means thus drawing the head 106 upwardly towards the guide tube 98. In this intermediate collapsed configuration, shown in FIG. 12, the apparatus is drawn downwardly out of the chimney. The apparatus can then be inverted to empty any debris that has collected in the canopy.

There then follows a second collapsing stage which involves pulling the spoke hub 20 down towards the handle 4. As this occurs, the link hub 76 moves away from the end cap 90 and the head 106 on the cord 104 is drawn into contact with the end 100 of the guide tube 98. Accordingly, as the spoke hub 20 is drawn towards the handle 4, the lower, middle and upper support members 44, 48 and 50 telescope into each other and the deployment spring 124 is compressed between the end cap 90 and the spring stop 126 at the handle end of the lower support member 44. Near the end of the second collapsing stage, the lower end 134 of the middle support member 48 displaces the pusher member 68 away from the latch projection 112. This displacement is in a clockwise direction as seen in FIGS. 8 and 9 and is against the biasing force of the spring 72. Finally, the head 106 is guided, by its engagement with the end 100 of the guide tube 98, down towards and finally into engagement with the latch projection 112. When the head 106 first comes into contact with the latch projection 112, an inclined lead-in surface 108 thereon comes into contact with the latch projection 112. As the guide tube 98 forces the head 106 further into the handle 4, the lead-in surface 108 slides down the latch projection 112 thereby moving the head 106 towards the latch spring 128 thereby compressing it. When the latching surface 110 of the head 106 reaches the end of the latching projection 112 the latch spring 128 moves the head 106 so as to engage the latching surface 110 of the head 106 with the latch projection 112. At this point the second collapsing stage is completed and the apparatus is in its fully collapsed configuration as shown in FIGS. 2, 3, and 8 in which the deployment spring 124 is in a compressed state and the canopy collapsing spring 77 is at least substantially relaxed or extended.

The apparatus is then ready to be deployed subsequently in the manner described above.

Figure 13:
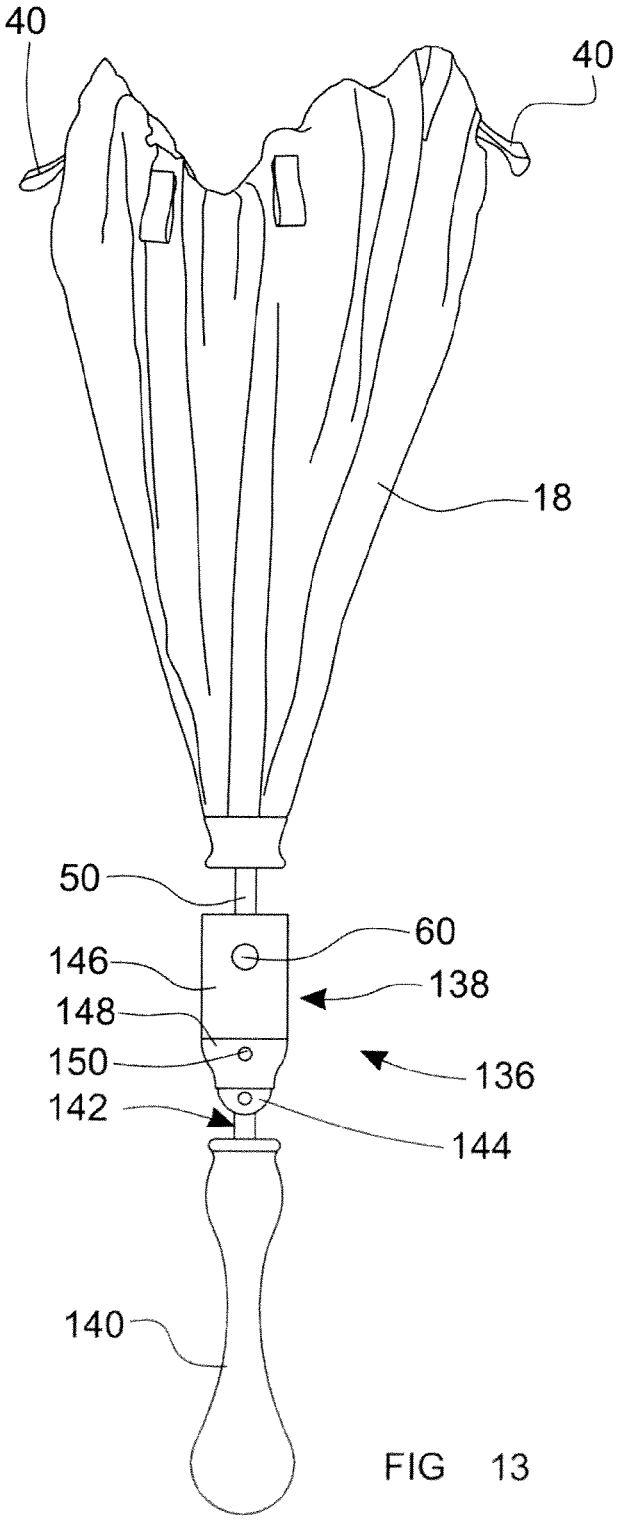
FIG. 13 is a side view of an alternative apparatus according to the invention in its collapsed configuration with an extendable handle.
Figure 14:
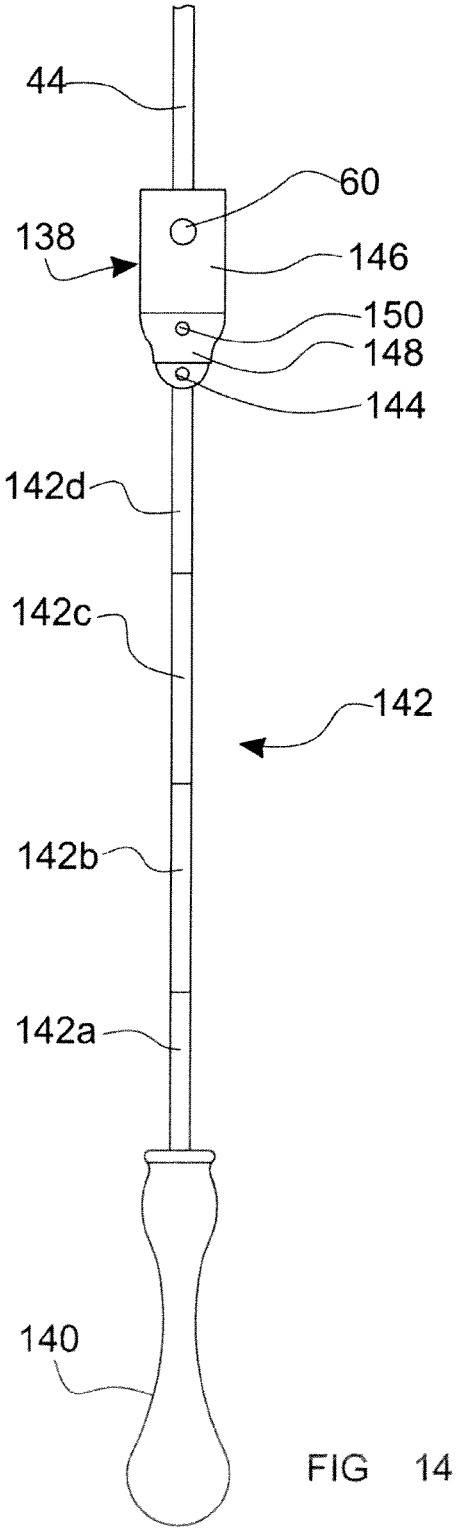
FIG. 14 is a side view of the handle section of the apparatus shown in FIG. 13 with the handle extended.

The handle 4 described above may be replaced by an extending handle 136 shown in FIGS. 13 and 14. The extending handle 136 comprises an upper handle part 138, which accommodates the push-button 60 and the associated mechanism described in detail above, a lower handle part 140 and a telescopic extension 142 which interconnects the upper part 138 and the lower part 140. The telescopic extension 142 comprises a plurality of elongate members 142*a* and 142*d*. In the embodiment shown in FIGS. 13 and 14 the telescopic extension 142 comprise four elongate members 142*a*, 142*b*, 142*c* and 142*d*. These elongate members telescope into each other and into the lower part 140 of the handle and are extendable into the configuration shown in FIG. 14 such that the upper part 138 of the handle is spaced above the lower part 140 of the handle. The uppermost elongate member 142*d* is connected to a lower end of the upper part 138 of the handle by a pivot 144 which allows articulation of the telescopic extension 142 about one or more preferably two axes which are perpendicular to a longitudinal axis of the telescopic extension 142. The advantages of the extending handle shown in FIGS. 13 and 14 is twofold. Firstly, even if the canopy 18 needs to be positioned a significant distance up a chimney, the telescopic extension 142 can be extended so that the lower part 140 of the handle remains visible in the fireplace so as to act as a reminder that the apparatus is installed and facilitate its removal. Secondly, even if the canopy 18 is canted over slightly in the chimney, the pivot 144 permits the telescopic extension 142 and the lower handle part 140 to be disposed vertically thereby providing a neat appearance of parts of the apparatus visible in the fireplace. The upper handle part 138 may comprise an upper portion 146 including the push-button and the associated mechanism and a lower portion 148 which is separable from the upper portion 146. A threaded securing means such as a machine screw 150 may be provided to secure the upper portion 146 to the lower portion 148. This arrangement allows parts 140, 142 and 148 to be replaced by alternative parts. It may for example be desirable to use a handle lower part 140 having an alternative shape or use a longer or shorter telescopic extension 142.

The apparatus described above provides a quick and convenient way to at least substantially block a chimney and subsequently remove the apparatus from the chimney. Such blocking will not only prevent draughts from passing up or down the chimney but will also effectively collect any debris that may fall down the chimney. As a result of the resilience of the chimney blocking means, the apparatus can effectively engage chimneys of a variety of different sizes. The adjustment means 40 can be altered to prevent folds of canopy material form forming around the perimeter 30 of the canopy 18 and reducing the effectiveness of the apparatus.

While a specific embodiment of the invention has been described, it will be understood that variations would be apparent to a skilled person which would still fall within the scope of the claims appended hereto.

The invention claimed is:

1. A chimney blocking apparatus for inserting into a chimney from a fireplace including a handle, support means extending from the handle for supporting chimney blocking means; wherein the support means are extendable along a longitudinal axis; wherein the support means are deployable outwardly away from the longitudinal axis; and an actuation mechanism configured to firstly extend the support means and deploy the chimney blocking means outwardly and secondly collapse the chimney blocking means inwardly towards the longitudinal axis; wherein the chimney blocking means, in its deployed state, has a concave surface facing away from the handle; the chimney blocking means including a flexible membrane having a peripheral portion; and an adjustment means for adjusting the peripheral portion of the flexible membrane for reducing folds in the flexible membrane to enable the membrane to more fully engage walls of a chimney to better catch falling debris; further comprising first and second spokes being configured for supporting the flexible membrane; the flexible membrane including first and second spoke end fittings for receiving the respective first and second spokes, and wherein the adjustment means includes a cord and a length adjuster for adjusting the length of the cord; and wherein the adjustment means extends between the first and second spoke end fittings.

2. The chimney blocking apparatus according to claim 1 wherein the actuation mechanism includes first resilient means for extending the support means and deploying the chimney blocking means outwardly and a second resilient means for collapsing the chimney blocking means inwardly towards the longitudinal axis.

3. The chimney blocking apparatus of claim 1 wherein the actuation mechanism includes a first hub displaceable along the support means and a second hub also displaceable along the support means and situated closer to the handle than the first hub.

4. The chimney blocking apparatus of claim 2 wherein the actuation mechanism includes a first hub displaceable along the support means and a second hub also displaceable along the support means and situated closer to the handle than the first hub and wherein a distance between the first and second hubs is variable and the second resilient means is situated between the first and second hubs to bias them away from each other.

5. The chimney blocking apparatus of claim 1 wherein the actuation mechanism includes a flexible tension member.

6. The chimney blocking apparatus of claim 5 wherein the actuation mechanism further includes releasable securing means for releasably securing the flexible tension member with respect to the handle.

7. The chimney blocking apparatus of claim 6 further including guide moans for guiding a head connected to the flexible tension member into engagement with the releasable securing means as the support means is compressed into a non-extended configuration.

8. The chimney blocking apparatus of claim 3 wherein the actuation mechanism includes a flexible tension member and wherein the flexible tension member extends between the first and second hubs.

9. The chimney blocking apparatus of claim 5 wherein a bight of the flexible tension member is situated at a distal portion of the support means.

10. The chimney blocking apparatus of claim 3 wherein the first huh includes an abutment surface which is selectively engageable with a complementary stop surface of the support means to arrest displacement of the first hub along the support means.

11. The chimney blocking apparatus of claim 1 wherein the actuation mechanism includes a releasable retention means for releasably retaining the support means in a non-extended configuration.

12. The chimney blocking apparatus of claim 1 wherein the flexible membrane has a substantially quadrilateral perimetral portion sized and configured for engaging interior wall surfaces of a chimney in which it is deployed for blocking airflow in the chimney past the flexible membrane.

13. A chimney blocking apparatus for inserting into a chimney from a fireplace including a handle, support means extending from the handle for supporting chimney blocking means; wherein the support means are extendable along a longitudinal axis; the chimney blocking means being deployable outwardly away from the longitudinal axis and an actuation mechanism configured to firstly extend the support means and deploy the chimney blocking means outwardly and secondly collapse the chimney blocking means inwardly towards the longitudinal axis; wherein the chimney blocking means, in its deployed state, has a concave surface facing away from the handle; the chimney blocking means including a flexible membrane having a peripheral portion, and an adjustment means for adjusting the peripheral portion of the flexible membrane for reducing folds in the flexible membrane to enable the membrane to more fully engage walls of a chimney to better catch falling debris; wherein the chimney blocking means includes first and second spokes and the flexible membrane includes first and second spoke end fittings for receiving the respective first and second spokes; and the adjustment means extends between the first and second spoke end fittings, and includes a cord and a length adjuster for adjusting the length of the cord; wherein the actuation mechanism includes a first resilient means for extending the support means and deploying the chimney blocking means outwardly and a second resilient means for collapsing the chimney blocking means inwardly towards the longitudinal axis; wherein the actuation mechanism includes a first hub displaceable along the support means and a second hub also displaceable along the support means and situated closer to the handle than the first hub; and wherein a distance between the first and second hubs is variable and the second resilient means is situated between the first and second hubs to bias them away from each other.

14. A chimney blocking apparatus for inserting into a chimney from a fireplace including a handle, support means extending from the handle for supporting chimney blocking means; wherein the support means are extendable along a longitudinal axis; the chimney blocking means being deployable outwardly away from the longitudinal axis; and an actuation mechanism configured to firstly extend the support means and deploy the chimney blocking means outwardly and secondly collapse the chimney blocking means inwardly towards the longitudinal axis; wherein the chimney blocking means, in its deployed state, has a concave surface facing away from the handle; the actuation mechanism including a first hub displaceable along the support means and a second hub also displaceable along the support means and situated closer to the handle than the first hub; wherein the chimney blocking means includes a flexible membrane; further comprising adjustment means for adjusting a peripheral portion of the flexible membrane for reducing folds in the chimney blocking means to enable the membrane to more fully engage walls of a chimney to better catch falling debris; wherein first and second spokes are configured for supporting the flexible membrane; the flexible membrane including first and second spoke end fittings for receiving the respective first and second spokes, wherein the adjustment means includes a cord and a length adjuster for adjusting the length of the cord; and wherein the adjustment means extends between the first and second spoke end fittings.

15. The chimney blocking apparatus of claim 14 wherein the actuation mechanism includes first resilient means for extending the support means and deploying the chimney blocking means outwardly and a second resilient means for collapsing the chimney blocking means inwardly towards the longitudinal axis.

16. The chimney blocking apparatus of claim 15 wherein a distance between the first and second hubs is variable and the second resilient means is situated between the first and second hubs to bias them away from each other.

17. The chimney blocking apparatus of claim 14 wherein a distance between the first and second hubs is variable.

* * * * *